US005549461A

United States Patent [19]

Newland

[11] Patent Number: 5,549,461

[45] Date of Patent: Aug. 27, 1996

[54] PERISTALTIC PUMP ATTACHMENT FOR SLURRY MIXERS

[76] Inventor: George Newland, 77 Cloverleaf Cir., Brentwood, Calif. 94513

[21] Appl. No.: 505,462

[22] Filed: Jul. 21, 1995

[51] Int. Cl.[6] ..... F04B 43/12

[52] U.S. Cl. ..... 417/477.11

[58] Field of Search ..... 417/474, 477.1, 417/477.9, 477.11; 366/51, 184, 190

[56] References Cited

U.S. PATENT DOCUMENTS

| | | | |
|---|---|---|---|
| 2,633,340 | 3/1953 | Zagray et al. | 259/169 |
| 2,822,154 | 4/1958 | Zagray et al. | 259/152 |
| 2,965,041 | 12/1960 | Clark | 417/477.11 |
| 3,011,684 | 12/1961 | Corneil | 417/477.11 |
| 3,227,426 | 1/1966 | Williams | 259/123 |
| 3,231,245 | 1/1966 | Harvey | 259/153 |
| 3,707,032 | 12/1972 | Brunelle et al. | 29/460 |
| 3,768,934 | 10/1973 | Magerle | 417/477 |
| 4,147,331 | 4/1979 | Kopecky | 366/46 |
| 4,189,286 | 2/1980 | Murry et al. | 417/477.11 |
| 4,474,217 | 10/1984 | DeMarse et al. | 138/137 |
| 4,558,996 | 12/1985 | Becker | 417/477.11 |
| 4,631,007 | 12/1986 | Olson | 417/476 |
| 4,730,993 | 3/1988 | Iwata | 417/477 |
| 4,969,808 | 11/1990 | Tsukada | 417/477 |
| 5,083,908 | 1/1992 | Gagnebin et al. | 417/477.11 |
| 5,096,393 | 3/1992 | Van Steenderen et al. | 417/477.11 |
| 5,230,614 | 7/1993 | Zanger et al. | 417/477.9 |
| 5,249,938 | 10/1993 | Hall | 417/477 |
| 5,342,182 | 8/1994 | Montoya et al. | 417/474 |
| 5,388,972 | 2/1995 | Calhoun et al. | 417/477.11 |

FOREIGN PATENT DOCUMENTS

| | | | |
|---|---|---|---|
| 2154286 | 5/1973 | Germany | 417/477.1 |
| 3840259 | 5/1990 | Germany | 417/477.9 |
| 2301684 | 12/1990 | Japan | 417/477.11 |
| 1262106 | 10/1986 | U.S.S.R. | 417/477.11 |
| 2069063 | 8/1981 | United Kingdom | 417/477.11 |

*Primary Examiner*—Peter Korytnyk
*Attorney, Agent, or Firm*—George W. Wasson

[57] ABSTRACT

A peristaltic pump is disclosed for attachment to a slurry mixing machine. The peristaltic pump includes an occluder ring, a pump rotor driven by the drive of the slurry mixing machine, a plurality of compression wheels driven by the pump rotor, and a flexible compressible hose. The occluder ring is supported on a hinged support in a manner that will permit the occluder ring to be hinged away from the compression wheels and flexible hose when slurries are not to be pumped through the hose and to be moved into cooperating alignment with the compression wheels and flexible hose when slurries are to be pumped. The hinged occluder ring functions as a clutch mechanism in the pumping of slurries.

9 Claims, 4 Drawing Sheets

FIG. 3
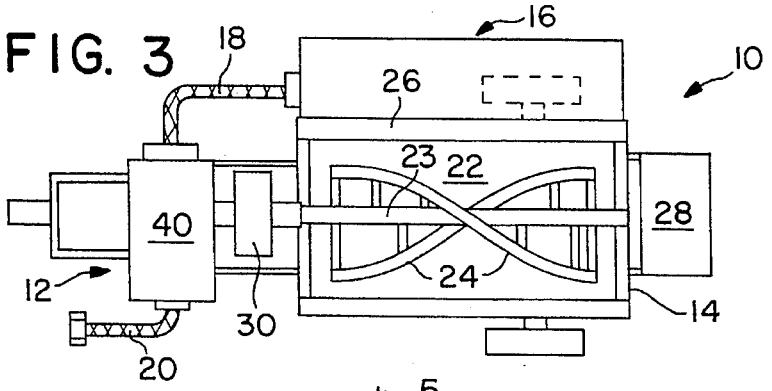
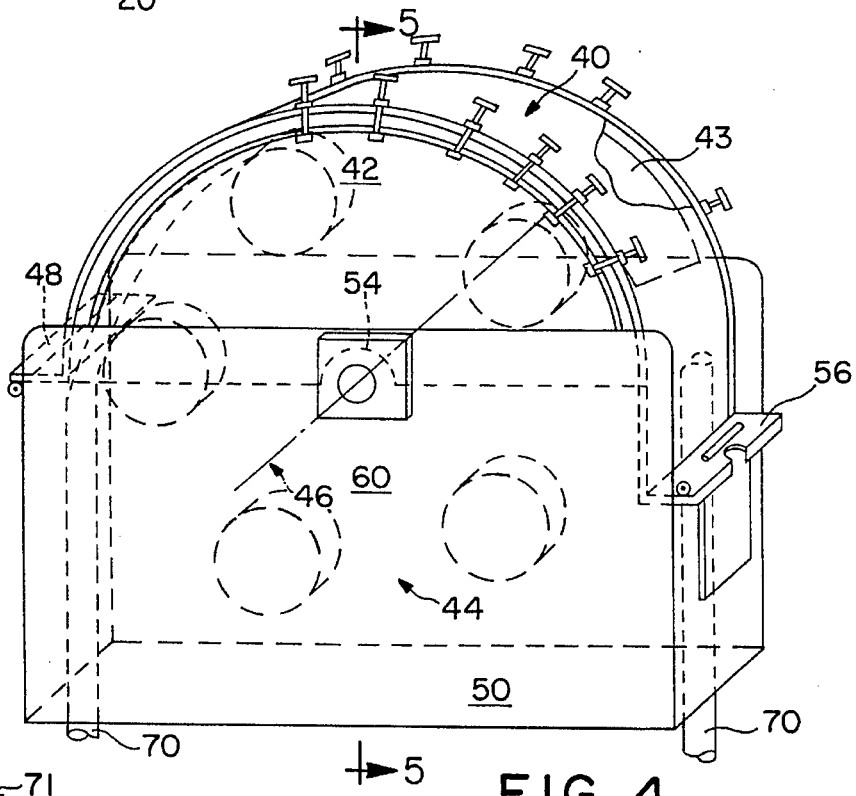
FIG. 4
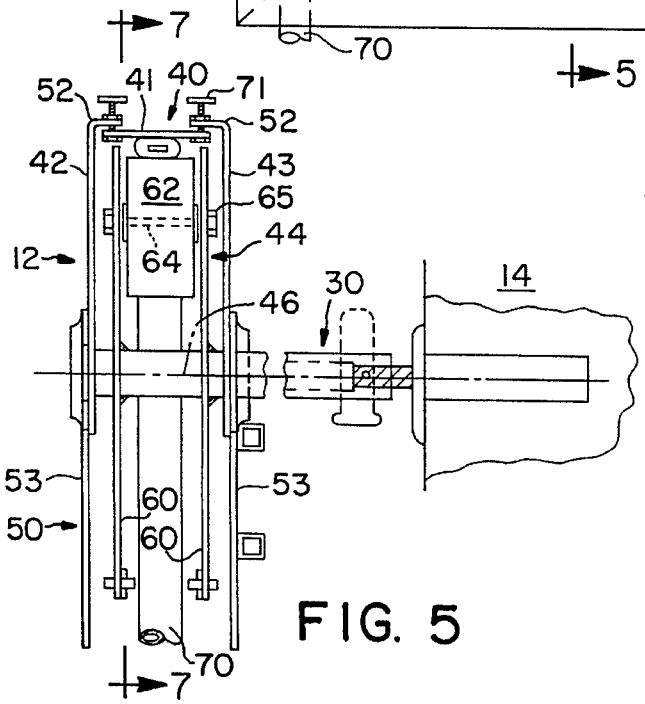
FIG. 5
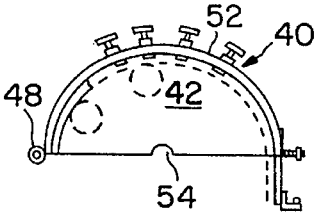
FIG. 6

PERISTALTIC PUMP ATTACHMENT FOR SLURRY MIXERS

This invention relates to a pump for moving slurry mixtures and more particularly to a peristaltic pump that may be connected to a slurry mixture supply, and may be continuously driven while being constructed to interrupt movement of the slurry mixture through the pump without having the pump disconnected from its drive. The pump is adapted to be attached to and driven by a machine for mixing the slurry mixtures so as to make the pump adapted to most conventional mixing machines.

FIELD OF THE INVENTION

The invention relates to machines for mixing, conveying and spraying cementitious slurries, fireproofing materials, plasters, and such modern specialty products such as acrylic stucco finishes, elastomeric paints and aggregate finishes.

PRIOR ART

In the construction industry, machines for mixing, conveying, and spraying cementitious slurries are well known. As machines for combining these functions, they utilize piston or Moineau type pumps as shown in U.S. patents Kopecky et al—U.S. Pat. No. 4,147,331, Williams—U.S. Pat. No. 3,227,426 and Zagray et al—U.S. Pat. No. 2,633, 340. The large machines shown in those patents are cost-prohibitive for the small contractor. Further, the piston and Moineau type pumps shown in those patents have many disadvantages. In U.S. patent to Magerle—U.S. Pat. No. 3,768,934—there is an exhaustive crituque of the piston type pump. The Moineau pump has even greater limitations; heat generation between the stator of its flexible casing while pumping precludes its use with either fiberglas impregnated stuccoes, or acrylic modified finishes.

Although Kopeckey et al have shown the feasibility of combining the mixing and conveying functions in a single machine, in no case could either a piston pump or a Moineau pump be retrofitted practically to a standard mortar mixer. Both frame obstuctions and shortness of power blade shaft would prevent a Moineau pump from being retrofitted.

Although U.S. patent to Iwata—U.S. Pat. No. 4,730, 993—shows a "squeeze pump" for conveying cementitious slurries, the mechanism there shown provides no clutch mechanism on the pump itself whereby mixing and conveying of slurries can be done simultaneously or separately at the choice of the operator. Thus, although it appears possible to retrofit such a pump to a standard mortar mixer, no means are shown or suggested to permit the pump to idle while the machine is mixing slurry. Only by means of a pump clutch, affecting either the occluder ring or the rotor of the pump, can this clutch function be accomplished. Further, Iwata's invention is limited to only a single hose size and no means are shown for prolonging the longevity of that hose.

SUMMARY OF THE INVENTION

An object of the present invention is to provide a pump for slurry mixtures that may be attached to and driven by a slurry mixer with the pump having a construction that functions as a clutch for the pump while the mixer continues its mixing function.

A further object in accord with the preceding object is the provision of a mechanical means for transferring the rotary power of a standard mortar mixer blade shaft to the rotor of an attached peristaltic pump, thus retrofitting the mixer to become a machine for both mixing and conveying slurries.

A further object in accord with the preceding objects is the provision of a clutch mechanism on the pump itself that permits the mixer to continue mixing while the pump is idling, or to permit the machine to mix and convey slurry materials simultaneously.

A further object in accord with the preceding objects is the provision of a means in a peristaltic that will permit the pump to be used with various sizes of internal pump hoses.

A further object in accord with the preceding objects is the provision of means in a peristaltic pump for controlling the volume and pressure of the pumped slurries within the conveying hoses so as to convey and spray a variety of slurries.

Further objects and features of the present invention will be readily apparent to those skilled in the art from the appended drawings and specification illustrating a preferred embodiment wherein:

BRIEF DESCRIPTION OF THE DRAWINGS

FIG. 3 is a top plan view of the assembly of the mixer and the pump.

FIG. 4 is an enlarged perspective view of the peristaltic pump of the present invention.

FIG. 5 is sectional view taken along the lines 5—5 of FIG. 4.

FIG. 6 is a side elevation view of the occluder ring, clam shell hinged casing and the pump casing of the present invention.

DETAILED DESCRIPTION OF THE DRAWINGS

Figure 1:
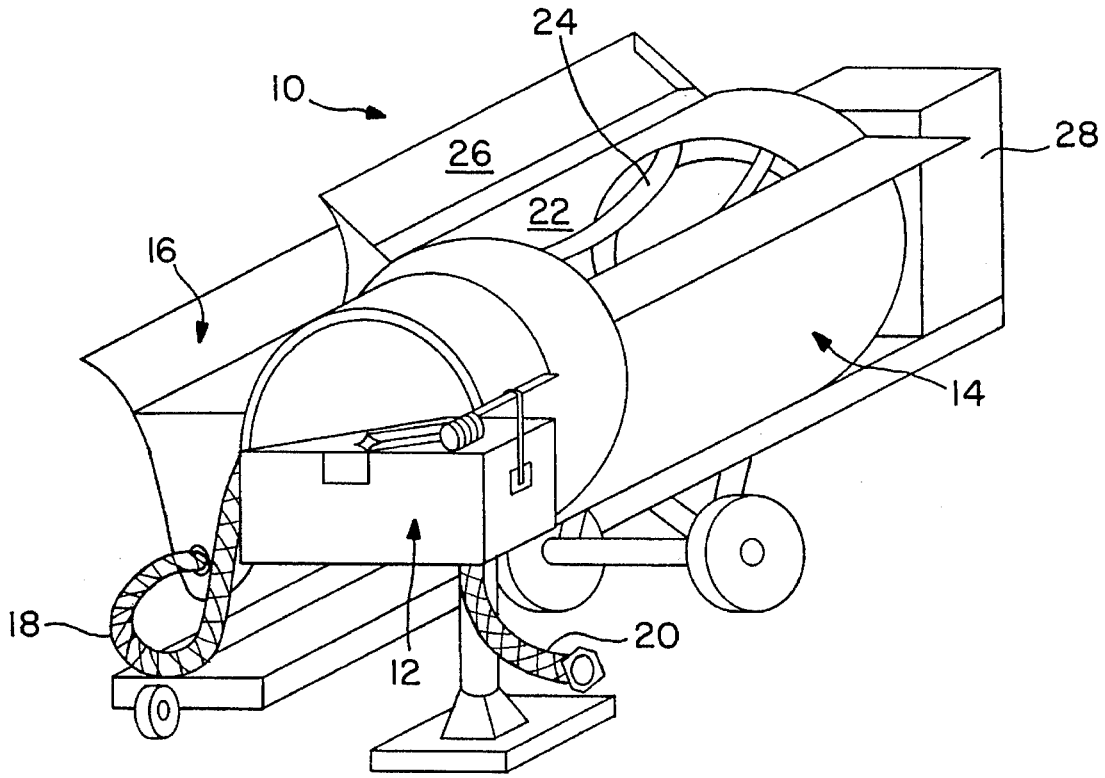
FIG. 1 is perspective illustration of a mixing machine with the pump of the present invention attached.

The present invention comprises a peristaltic pump adapted to be attached to and driven by a slurry mixing machine. A peristaltic pump is a device that uses an elastic tubing for conveying fluid materials. The materials are drawn into the elastic tubing as the tubing is successively compressed in the direction of delivery of the fluid. In the present application of this pumping principal, the elastic tubing is compressed by rotary compression wheels acting to compress the tubing against a stationary wall. The advantage of the present application of the peristaltic pump is that there is an effective clutch-like control of the pumping action. The assembly of those elements is shown at 10 in FIG. 1 where the peristaltic pump assembly is shown at 12, the mixer is shown at 14, a hopper is shown at 16, an input hose 18 connects the hopper 16 to the pump 12 and an output hose 20 is connected to the pump 12. It should be understood that the mixer 14 includes a mixing tank 22 with internal power blade mixing shaft 23 and driven mixing blades 24 that are driven with respect to the tank to mix a slurry within the tank. The tank 22 is supported on rotary bushings so as to be rotatable about its central axis to permit dumping of a mixed slurry from the tank 22 into the hopper 16. The tank is formed with a pouring lip 26 for directing the mixed slurry into the hopper 16. A suitable drive engine or motor rotates the power blade mixing shaft 23 within the tank and the mixing blades 24 are suitably attached to that drive shaft. The peristaltic pump 12 of the present invention is attached by suitable means to an extension of the drive shaft 23 of the mixer to provide rotary drive for the pump.

Figure 2:
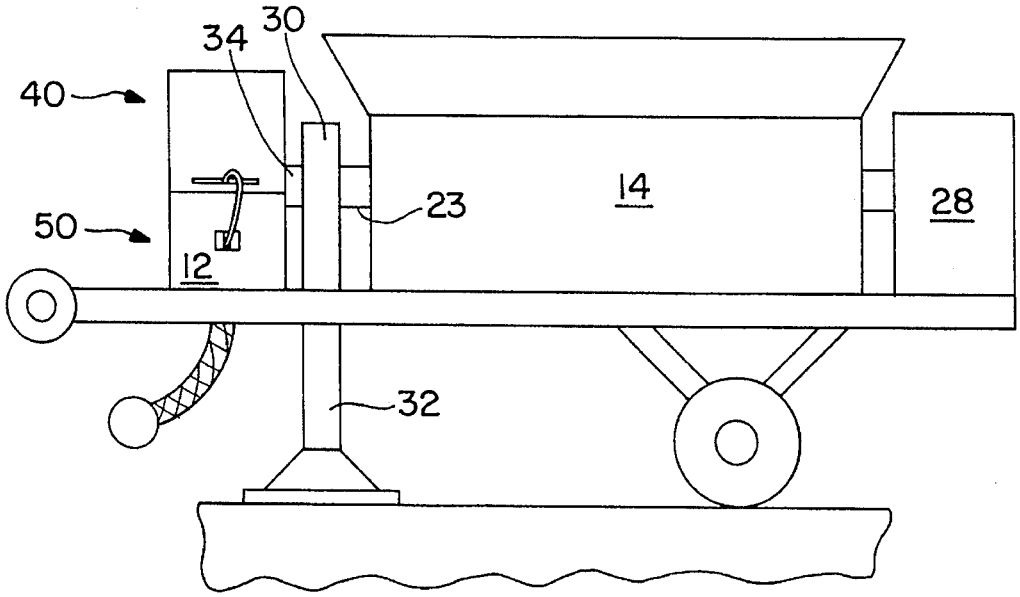
FIG. 2 is a side elevation view of the assembly of the mixer and the pump.

FIGS. 2 and 3 illustrates the alignment of the mixer and pump on a suitable framework that may include wheels for moving the assembly and a hitch for connecting the wheeled assembly to some form of a tow vehicle. The drive engine or motor may take the form of the elements 28 shown at one end of the framework; the drive is connected to the power blade mixing shaft 23 of the mixer 14 and passes through the mixer at the opposite end to provide a power take-off shaft. The pump 12 is attached by a suitable coupling 30, to be more fully described hereinafter, at the front bowl stantion or mast 32 of the mixer assembly 10.

The peristaltic pump 12 of the present invention, having been fixed to the forward bowl stantion or mast 32 of the mixer 10, has an extending, rotor shaft 34 coupled by coupling means 30 to the power blade mixing shaft 23 of the mixer 14. This coupling is accomplished by means of a double chain sprocket assembly whereby opposing sprockets, mounted respectively on the rotor pump shaft 34 and the mixer blade power shaft 23, are joined by a double chain encompassing both sprockets. With that connection, the torquing energies of the power blade mixing shaft 23 are transferred to the pump rotor 34.

As shown in FIGS. 4–8, the peristaltic pump of the present invention consists of an occluder ring support 40 forming a partial cylindrical surface joined by side walls 42 and 43. Suspended from the occluder ring support 40 is an adjustable steel plate which comprises the occluder ring 41. A pump rotor assembly 44 is rotatably supported on an axis 46 that is an extension of the axis of the coupling 30 between the mixer 14 and the pump 12; the axis of the occluder ring support element 40 is concentric with the pump axis in its closed position. The occluder ring support element 40 is formed to fit outside the side walls of a pump casing 50 and is hinged at 48 so as to be movable to enclose the pump rotor assembly 44 between the outer partial cylindrical surface 52 and the side walls 53. The side walls 53 are notched at 54 at the center of the partial cylindrical form to accommodate the drive shaft 46 at the axis of the pump. At the side opposite to the hinge 48, the occluder ring 41 is provided with a latch lip 56 that functions in the locking of the occluder ring in its pumping location as will be described hereinafter.

As shown in FIGS. 4 and 5, the interior of the pump rotor assembly 44 includes a pair of compression wheel discs 60 fixed, as by welding, to the pump shaft 46 so as to rotate with the driven pump shaft. A plurality of equally spaced compression rollers 62 are rotatably supported on shafts 64 that are attached to the compression wheel discs 60 by means here shown as fasteners 65; the support of the compression rollers also includes suitable spacers that maintain the spacing of the compression wheel discs 60. The dimensions of the interior of the occluder ring and the circumference of the compression wheel discs are such that the compression wheel discs can be rotated within the occluder ring without interference and the compression rollers are of a dimension that will permit them to be rotated with the compression wheel discs with a limited clearance between the rollers and the interior of the occluder ring. As shown in FIGS. 1, 4 and 5, a flexible hose 70 which includes the input hose 18 and the output hose 20 passes through the pump 12 in the space that is between the inside surface of the occluder ring 41 and the compression rollers 62.

Figure 7:
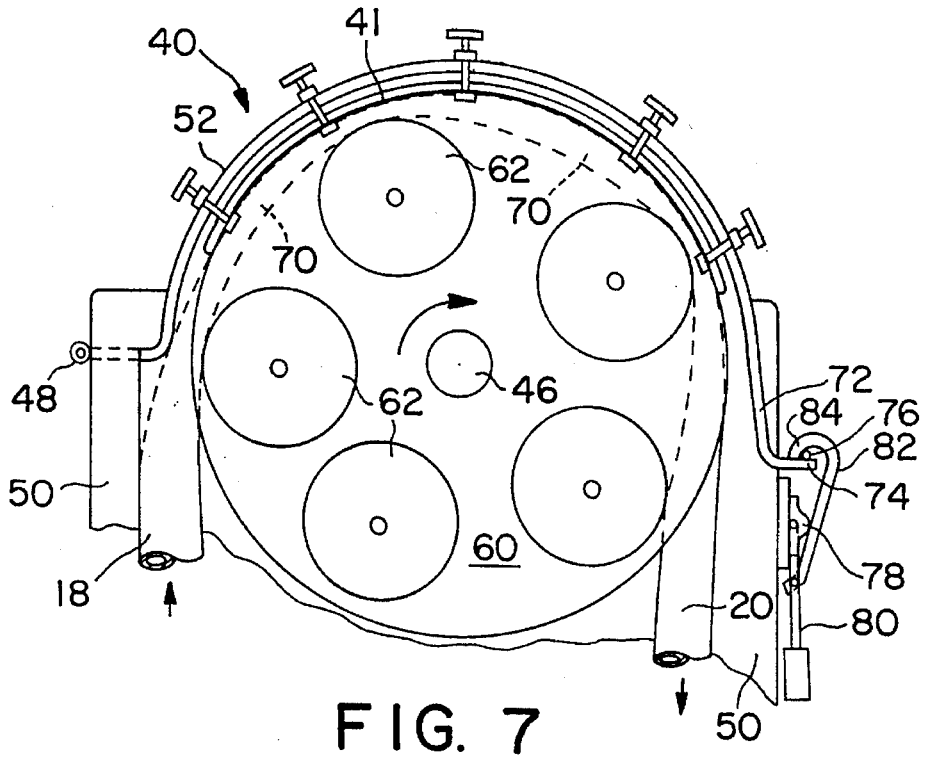
FIG. 7 is a side elevation view of the compression wheel disc and showing the occluder ring enclosed around the compression wheel disc.
Figure 8:
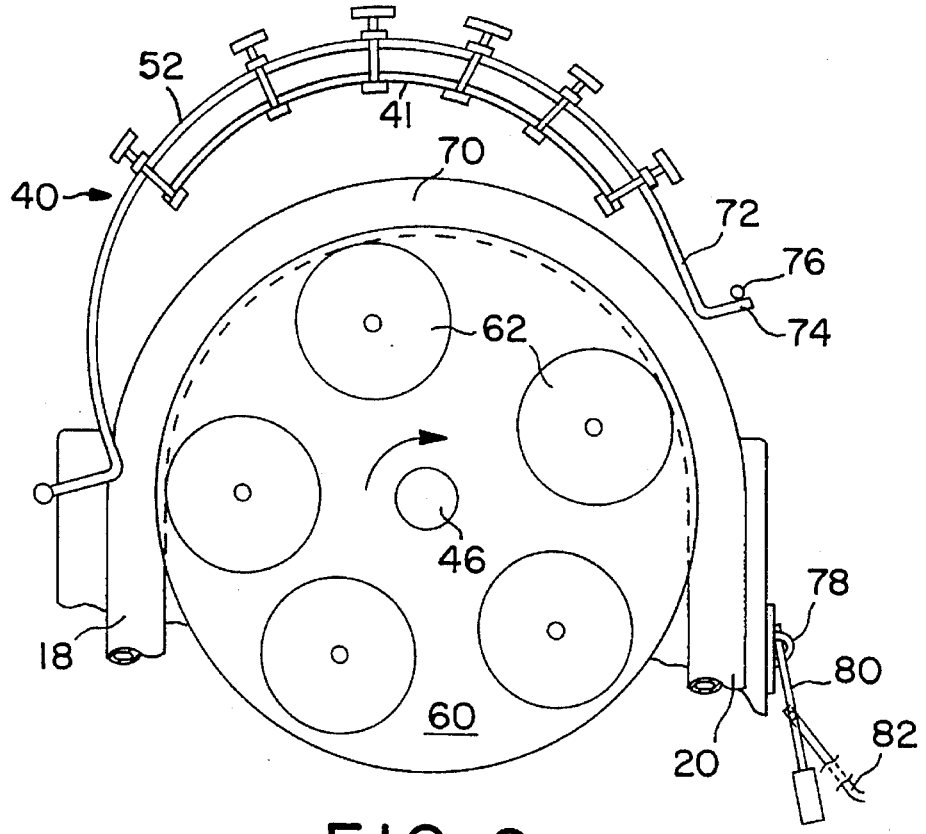
FIG. 8 is a side elevation view like FIG. 7 with the occluder ring in its open position.

FIGS. 7 and 8 illustrate the relationship of the occluder ring support element 40, the occluder ring 41 and the pump rotor assembly 44 in the positions for pumping, FIG. 7, and in the position for non-pumping, FIG. 8. In FIG. 7 the occluder ring 41 is clamped about the pump rotor assembly 44 to press the flexible hose 70 against the compression rollers 62 where those rollers are positioned; between the roller positions the flexible hose 70 expands to its normal form. At the top of FIG. 5, the flexible hose is shown in its compressed configuration, and in FIG. 7, the hose is shown compressed between the rollers 62 and the occluder ring 41 except in the space between the rollers. It should be understood that the pump rotor assembly 44 is rotated within the occluder ring 41 in the direction of the arrow shown above shaft 46 so that the compression of the flexible hose 70 is a rolling action along the hose and the expansion to the normal form of the hose also moves along the hose. FIG. 8 illustrates the form of the hose 70 when the occluder ring 41 is hinged away from the pump rotor assembly 44; in the position illustrated, the flexible hose 70 is expanded to its normal form and the compression rollers 62 roll along the exterior surface of the hose without compressing the hose.

FIGS. 7 and 8 also illustrate a form of clamping mechanism that can be used to close the occluder ring 41 against the pump rotor assembly 44. The side of the occluder ring 41 opposite to the hinged side at 48 is provided with an extension 72 and a latching lip 74 with a barrier 76 is fixed to that extension. The pump casing 50 is provided with a latch keeper 78 and a latch bar 80 is supported in the keeper. A latch hook 82 is supported midway along the latch bar 80 in a manner to be pivoted on the latch bar. The latch hook has a free end at 84 that can be aligned with the barrier 76. When the free end 84 and the barrier are aligned, the latch bar 80 can be rotated about the latch keeper 78 to force the occluder ring 41 into its engagement with the pump rotor assembly to cause the flexible hose to be compressed in the rolling manner as the rollers 62 are moved. When the latch is released, the occluder ring can assume the position as shown in FIG. 8.

The rotation of the occluder ring 41 with respect to the rotor pump assembly 44 causing the engagement and disengagement of the rollers 62 and the flexible hose 70 functions as a clutch for the pump 12 and permits the mixer or drive shaft for the rotor pump assembly 44 to continue to rotate while the pumping action is idle even though the pump rotor assembly is rotated.

Before the pumping of a mixer slurry can be performed, the mixed slurry must first be deposited into the slurry hopper 16 into which the intake hose 18 has been inserted or connected. With the occluder ring 41 clamped against the rotor assembly engaging the rollers 62 and the flexible hose, a vacuum is created by the revolving of the compression rollers 62 squeezing against the flexible hose 70 causing the mixed slurry to be drawn into the input hose 18 through the flexible hose 70 and to exit through the output hose 20. Pumping will continue so long as the hopper 16 holds mixed slurry or until the occluder ring support 40 is released from its engagement with the pump rotor assembly.

The present invention can be modified to accommodate flexible hoses of different diameters by means of the adjustable occluder ring 41. The space 63 between the rotating compression wheels 62 and the occluder ring 41 in FIG. 5 can be modified by means of threaded bolts 71 passing through nut 73 fixed to both the occluder ring support element 40 and the occluder ring 41. The present invention can also be modified to accommodate flexible hoses of different diameter by providing shim plates 66 along the interior of the occluder ring. Such a shim is shown partially in FIG. 6 as secured to the interior of the occluder ring. The shims 66 can be made of slightly compressible materials that will reduce the stress on the flexible hose 70 and possibly extend the life of such a hose.

Figure 9:
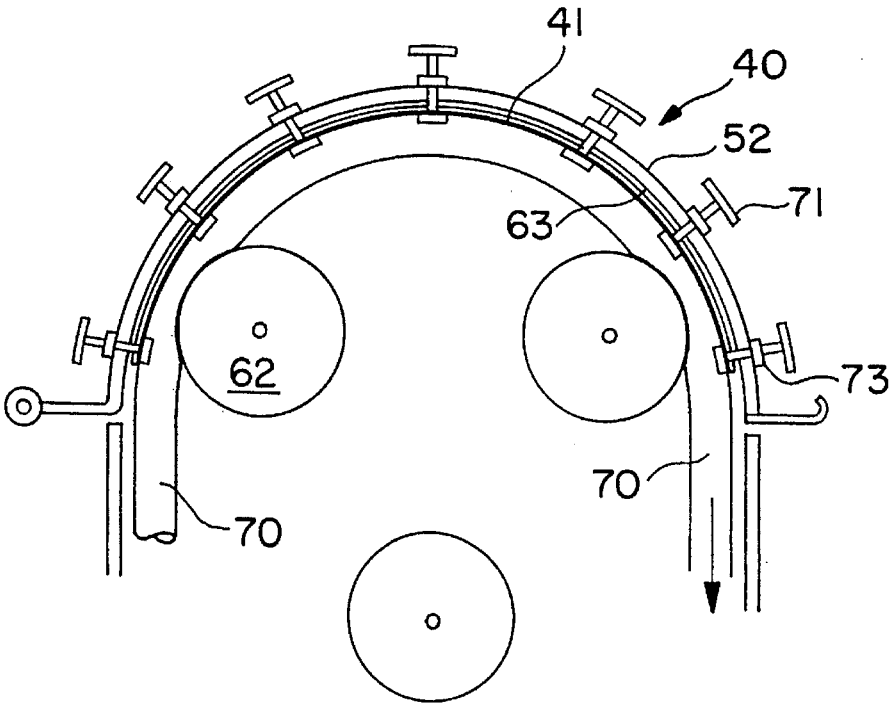
FIG. 9 is an assembly drawing in section of the compression wheel assembly.

By means of the same adjustable occluder ring, both the volume and the pressure of the mixed slurry being conveyed can be controlled. In FIG. 9, by successively retracting the occluder ring 41 incrementally from the exhaust end of the pump hose 70, the amount of material entering the hose can be controlled. This will occur only if the linear amount of hose being compressed between wheels 62 remains less than the circumferential distance between wheels. Pulsations which will result from air spaces in the hose can be compensated for by means of a larger volume pressure vessel at the end of the pump hose which can absorb these energies and effect a continuous, smooth flow of materials in the placement hose.

The volume of mixed slurry entering the pump may be regulated by use of a mechanical adaptation comprising a flat surfaces hose cover plate fixed to a threaded spindle inserted into a fixed threaded nut attached to the end of the input hose 18. The volume of the mixed slurry may be altered by rotating the cover plate of the attachment with respect to the hose to increase or decrease the distance of the cover plate from the hose orfice causing an increase or decrease of material flow into the hose. The variable pressure control and relief valve at the exit end of the flexible hose is used not only to relieve conveying hose pressure arising from obstructions or hose pinches, but specifically in conjunction with the volume control mechanism. In this manner the volume and pressure of pumped slurries of varying viscosities can be minutely controlled.

Figure 10:
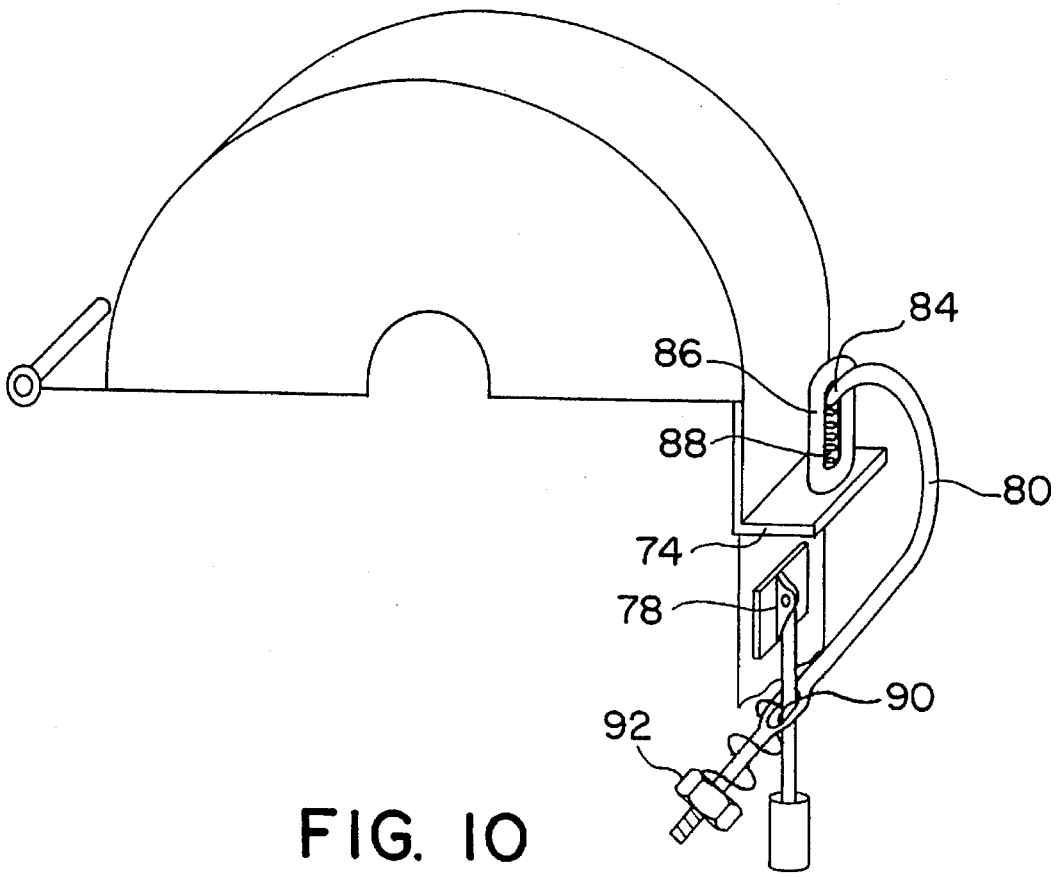
FIG. 10 is a perspective view of an alternative latch assembly.

FIG. 10 illustrates a modification of the latch mechanism as shown in FIGS. 7 and 8, for the purpose of providing a relief to the pressure which can be developed within the flexible hose 70. It is possible that with maintaining a desired mixer shaft revolution speed an excessive speed can occur for pump rotator assembly 44 and thus an excessive pressure may develop in the flexible hose 70. The modified mechanism of FIG. 10 replaces the latch barrier 76 with a slotted tube 86 containing a compression spring 88 on the latch lip 74. The connection of the latch bar 80 and latch keeper 78 are also modified by providing an adjustment slot 90 and a spring biased adjustment nut 92 cooperationg with a treaded end 94. When the mechanism of FIG. 10 is in it clamped position for holding the occluder ring 41 against the flexible hose 70 and with compression rollers against the flexible hose 70, the latching of the occluder ring 41 is flexible to the extent that if excessive pressure develops in the flexible hose, that pressure can be relieved by permitting the occluder ring 41 to move upward by compressing spring 88 acting against the free end 84 within the slotted tube 86. The initial position of the end 84 within the slotted tube 86 can be determined by the adjustment of the nut 92 to adjust the length of the latch bar 80.

While certain preferred embodiments of the present invention have been specifically disclosed, it should be understood that the invention is not limited thereto as many variations will be readily apparent to those skilled in the art and the invention is to be given its broadest possible interpertation within the terms of the following claims.

I claim:

1. A peristaltic pump comprising:

a) an occluder ring support having side walls and a partial cylindrical surface occluder ring joined to said side walls, b) a pump rotor and an axis for rotatably supporting said rotor, c) a plurality of compression wheels rotatably supported on support axes parallel to and radially spaced from said axis of said rotor, d) said occluder ring support being supported at one end of said partial cylindrical surface on a hinge radially spaced from said axis of said pump rotor, said partial cylindrical surface occluder ring having a radius of formation larger than the radius of said pump rotor, e) said hinged support of said occluder ring support with respect to said axis of said pump rotor providing an open space between said partial cylindrical surface of said occluder ring and said pump rotor when said occluder ring support is hinged away from said axis of said pump rotor, f) means for adjusting the position of said partial cylindrical surface occluder ring with respect to said pump rotor to vary said open space between said cylindrical surface of said occluder ring and said compression wheels, g) a flexible hose within said occluder ring support adjacent to said partial cylindrical surface and in said open space when said occluder ring support is hinged away from said axis of said pump rotor, h) means for connecting said axis of said pump rotor to means for producing rotary motion, i) and means for clamping said occluder ring support in position to align said axis of said partial cylindrical surface occluder ring concentric with said axis of said pump rotor and to position said compression wheels in contact with said flexible hose in said open space as said pump rotor is rotated, said means for clamping including means for varying the position of said partial cylindrical surface occluder ring with respect to said compression wheels dependent upon pressure within said flexible hose, j) whereby rotary motion of said pump rotor with respect to said occluder ring support causes said compression wheels to compress said flexible hose in a rolling engagement along said partial cylindrical surface of said occluder ring and to pump slurry materials through said peristaltic pump, and whereby said pumping by said peristaltic pump is controlled by the position of said occluder ring partial cylindrical surface, with respect to said axis of said pump rotor.

2. A peristalic pump attachment for a slurry mixer and for conveying slurry materials from said mixer, said mixer including means for producing rotary motion, said pump attachment comprising:

a) a pump casing having at least side walls and end walls and an open surface and means for supporting said pump casing on said mixer, b) a pump rotor rotatably supported on an axis on said side walls of said pump casing, means for connecting said pump rotor to means for producing rotary motion in said mixer, c) a plurality of compression wheels rotatably supported on said pump rotor, d ) an occluder ring support, said occluder ring support including a semicircular cross-section occluder ring having side walls and a partial cylindrical surface joined to said side walls and forming said semicircular cross-section, e) said occluder ring support being hinged at one end of said partial cylindrical surface on one of said end walls of said pump casing and adapted to close said open surface of said pump casing at the opposite end of said partial cylindrical surface, f) means for releasably clamping said occluder ring support to said pump casing at the end of said partial cylindrical surface opposite to said hinged end of said partial cylindrical surface, g) a flexible hose within said casing and extending from said casing in cooperative alignment with said compression wheels of said pump rotor and within said occluder ring support, h) said hinged support of said occluder ring support on said casing providing an open space between said partial cylindrical surface of said occluder ring when hinged away from said casing, said flexible hose being positioned within said open space, i) and said compression wheels adapted to rotate with said pump rotor through said open space and to compress said flexible hose against said partial cylindrical surface of said occluder ring when said occluder ring support is clamped to said pump casing, j) whereby, with said occluder ring support clamped to said pump casing, rotary motion of said pump rotor with respect to said pump casing and occluder ring partial cylindrical surface causes said compression wheels to compress said flexible hose in a rolling engagement with said partial cylindrical surface of said occluder ring and to convey materials through said peristaltic pump, and whereby pumping by said peristaltic pump is controlled by the hinged position of said occluder ring support with respect to said pump casing.

3. The peristaltic pump of claim 2 wherein said occluder ring support includes means for adjusting the position of said occluder ring partial cylindrical surface with respect to said compression wheels.

4. The peristaltic pump of claim 3 wherein said means for adjusting said position is a shim means within said occluder ring support.

5. The peristaltic pump of claim 3 wherein said means for adjusting is a means for adjusting the position of said occluder ring partial cylindrical surface with respect to said side walls.

6. The peristaltic pump of claim 2 wherein said means for clamping includes means for varying the position of said occluder ring support with respect to said compression wheels dependent upon pressure within said flexible hose.

7. The peristaltic pump of claim 2 wherein said peristaltic pump rotor can rotate continuously within said occluder ring support with said mixer rotary motion producing means without pumping slurry materials through said flexible hose.

8. The peristaltic pump of claim 2 wherein said occluder ring support is adapted for accommodating flexible hoses of varying sizes.

9. The peristaltic pump of claim 2 wherein said slurry mixer includes a hopper and hose means for connecting said hopper to said flexible hose of said peristaltic pump.

* * * * *